US006964941B2

(12) United States Patent
Argentieri et al.

(10) Patent No.: US 6,964,941 B2
(45) Date of Patent: Nov. 15, 2005

(54) CLEANING COMPOSITION AND DEVICE FOR ELECTRONIC EQUIPMENT

(75) Inventors: Andrea Filippo Argentieri, Brussels (BE); Sergio Rossi, Ferrara (IT); Stefano Scialla, Rome (IT); Murat Gökce Suer, Istanbul (TR); Giovanni Grande, Rome (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/859,029

(22) Filed: May 16, 2001

(65) Prior Publication Data

US 2002/0111283 A1 Aug. 15, 2002

(30) Foreign Application Priority Data

Jun. 2, 2000 (EP) ..... 00111746

(51) Int. Cl.[7] ..... C11D 7/52

(52) U.S. Cl. ..... 510/175; 510/407; 510/417; 510/506; 134/2; 134/3

(58) Field of Search ..... 510/175, 407, 510/417, 506, 365, 202, 412, 475; 134/2, 3

(56) References Cited

U.S. PATENT DOCUMENTS

| | | | | | |
|---|---|---|---|---|---|
| 4,966,481 | A | | 10/1990 | Satten et al. | |
| 5,246,618 | A | | 9/1993 | Buchwald et al. | |
| 5,345,651 | A | | 9/1994 | Roberts | |
| 5,389,281 | A | * | 2/1995 | Davies et al. | 510/168 |
| 5,470,500 | A | * | 11/1995 | Lupyan et al. | 510/394 |
| 5,536,327 | A | * | 7/1996 | Kaiser | 134/1 |
| 5,624,239 | A | | 4/1997 | Osika | |
| 5,637,142 | A | * | 6/1997 | Kubo et al. | 106/285 |
| 5,679,175 | A | * | 10/1997 | Hayes et al. | 134/26 |
| 5,698,138 | A | * | 12/1997 | Visca et al. | 516/22 |
| 5,756,002 | A | * | 5/1998 | Chen et al. | 252/364 |
| 5,780,414 | A | | 7/1998 | Silvani et al. | |
| 5,814,595 | A | * | 9/1998 | Flynn et al. | 510/411 |
| 5,827,454 | A | | 10/1998 | Kenroh et al. | |
| 5,851,977 | A | | 12/1998 | Gorton et al. | |
| 5,938,858 | A | | 8/1999 | Yokoyama et al. | |
| 5,980,642 | A | | 11/1999 | Strepparola et al. | |
| 6,008,179 | A | | 12/1999 | Flynn et al. | |
| 6,376,452 | B1 | * | 4/2002 | Flynn et al. | 510/412 |

FOREIGN PATENT DOCUMENTS

| | | |
|---|---|---|
| DE | 196 09 940 A1 | 9/1997 |
| DE | 297 15 059 U1 | 12/1997 |
| DE | 298 13 015 U1 | 12/1998 |
| EP | 0 008 209 A1 | 2/1980 |
| EP | 0 195 336 A2 | 9/1986 |
| EP | 0 980 910 A2 | 2/2000 |
| GB | 2 276 311 A | 9/1994 |
| JP | 61 188498 A | 8/1986 |
| JP | 63 178198 A | 7/1988 |
| JP | 08 041494 A | 2/1996 |
| JP | 08 280596 A | 10/1996 |
| JP | 11 050097 A | 2/1999 |
| WO | WO 99/38947 A1 | 8/1999 |

* cited by examiner

*Primary Examiner*—Gregory Webb
(74) *Attorney, Agent, or Firm*—Brent M. Peebles; Jeffrey V. Bamber; Kim William Zerby

(57) ABSTRACT

A chemical cleaning composition for cleaning electronic equipment and electric or electronic appliances, a device for the application of such composition, and a method of cleaning such equipment are disclosed.

6 Claims, 3 Drawing Sheets

CLEANING COMPOSITION AND DEVICE FOR ELECTRONIC EQUIPMENT

CROSS-REFERENCE TO RELATED APPLICATIONS

This application claims the benefit of the filing date of EPO patent application Serial No. 00111746.4, filed Jun. 2, 2000.

FIELD OF THE INVENTION

The present invention relates to a chemical cleaning composition and a device for the application of such composition. More particularly, the invention relates to the cleaning of electronic equipment and electric or electronic appliances by such composition and device. This invention may also include the use of a cleaning composition comprising at least one fluorinated carbon compound on such equipment and an applicator for applying the composition.

BACKGROUND OF THE INVENTION

Private households acquire a high and constantly increasing number of electronic equipment. In most western households one will find a radio, a TV set, a stereo rack, a camera, a calculator, a telephone and likely also at least one remote control for at least one such device. More recently developed devices, which at the beginning of the 21$^{st}$ century also become more and more common, are portable and desktop personal computers, palmtop devices, mobile phones, touch screen LCD displays, CD, DVD, MP3 audio and video equipment, play stations and the like.

These devices, both when used in a private ambience and in a business environment, represent a particular challenge in terms of cleanness and hygiene. Being largely designed in view of technical needs rather than ease of cleaning, they often comprise difficult to reach and/or difficult to clean surfaces, a prime example for such a surface being a keyboard or keypad, which in one or the other form is comprised by most such devices.

A further challenge in relation to the cleaning of any such device, is that they are typically delicate and further will suffer damage from contact with water or most other liquids. When water intrudes such device, e.g. via the keypad, due to the highly integrated and compact design of such devices, liquid is bound to induce a short-circuit and thereby typically unrepairable damage.

Besides the need for cleanness and hygiene in a private ambience and for the comfort of the user, often such devices are shared between different users, e.g. computers and telephones, in particular in a business and office environment, where cleanness is particularly relevant for the comfort of usage and lack of cleanness may even mean a risk of spreading infections. In a further aspect cleanness may be required for the proper functioning of a device, e.g. a touch screen LCD display.

A number of dedicated cleaning devices for electronic and other delicate equipment is known. Some devices solely or predominately rely on the mechanical removal of dirt, dust and the like. For example, DE 29813015 discloses a sponge shaped to match the contours of a typical keyboard and DE 19609940 discloses a device comprising a number of brushes, which can be mechanically adjusted to match the contour of a given keyboard. DE 29715059 discloses a cleaning device for computer keyboards comprising a wedge-shaped pad of absorbent material. In GB 2276311 a hand-held furniture vacuum cleaner is disclosed, also for use on computer keyboards, and in view of the same usage in U.S. Pat. No. 5,345,651 a nozzle brush attachment for a vacuum cleaner is disclosed. A product comprising a brush and a wiping surface, to be used particularly for cameras and optical equipment, is marketed under the name of "LensPen" by International Parkside Products of Vancouver, Canada.

Other devices employ cleaning liquids and rely less on purely mechanical removal of dust and dirt. For example, U.S. Pat. No. 5,624,239 discloses a portable device comprising a fluid source and a vacuum device. Kensington of California, USA, markets pre-moistured wipes for use on computers, keyboards and other office equipment, however, the wipes are said not to be suitable for notebook and anti-glare screens. CleanTex of New York, USA, markets a variety of cleaning wipes for different surfaces including those for computers and computer screens. 3M of Minnesota, USA, under the trade name of "Keyboard Cleaner" markets a three piece kit comprising a mechanical device and a cleaning solution.

Obviously, a large number of chemical compositions are known to be useful for cleaning tasks. Some consumers are known to use home care products, such as detergents and all purpose cleaners (appropriately diluted in water), also for technical equipment in their household. An alternative choice may be to use an isopropyl alcohol, which for example is comprised by CleanTex wipe No. 833, which is recommended for computer screens.

Other compositions are known to be useful for specific industrial applications: U.S. Pat. No. 5,246,618 discloses compositions based on fluorochlorohydrocarbons, alcohols and at least one ester and particularly their use for removing soldering flux and soldering flux residue from printed circuit boards. WO 99/38947 discloses an organic-based composition comprising a fluorinated compound, a high polarity solvent and a low polarity solvent. The composition is disclosed for use in the cleaning industry and in a preferred method of usage an object to be cleaned is treated with the boiling composition and the vapours thereof. The composition is disclosed as suitable for circuit boards and live electrical circuits and also sensitive plastic surfaces, including polycarbonate and polyacrylic surfaces.

U.S. Pat. No. 5,980,642 discloses a method for removal of water from surfaces by use of a composition comprising a fluoropolyether, the method to be used in particular in the electronics and fine mechanics field.

U.S. Pat. No. 5,780,414 discloses solvents consisting of certain hydrofluoropolyethers as cleaning rinsing agents and their use for the removal of oily substances.

JP 63178198A2 discloses a composition comprising mainly trichlorotrifluoroetane which is said to be suitable for word processors, personal computers and keyboards. Chlorinated compounds are known to contribute to the depletion of ozone in the ozonosphere and further to the global warming. Considering that, in those developed countries where a large number of consumers employ sophisticated electronic equipment of the mentioned types, among consumers there is also a considerable awareness of environmental issues, such composition is not ideal for a product to be sold on a large scale. In view of the prior art, it remains an objective to provide:

- a cleaning device and composition of high cleaning performance suitable for household equipment, office equipment, electrical or electronic equipment, optical equipment, and similar equipment as listed herein.

- a cleaning device and composition suitable for the multitude of different surfaces, including plastic surfaces and delicate surfaces, found on such equipment.
- a cleaning device and composition which is environmentally friendly.
- a cleaning device and composition which is easy to apply and use.
- a cleaning device and composition which is safe to use and preferably avoids skin contact of any cleaning composition with the skin of the user.
- a cleaning device and composition which is electro-safe.
- a cleaning device which further provides optimal mechanical dust and dirt removal performance.

SUMMARY OF THE INVENTION

The present invention relates to a chemical cleaning composition and a device for the application of such composition. The present invention may also include: the use of a cleaning composition comprising at least one fluorinated carbon compound on household equipment, office equipment, electrical or electronic equipment, optical equipment, and similar equipment as listed herein; a method of cleaning such equipment; and an applicator comprising such cleaning composition.

BRIEF DESCRIPTION OF THE DRAWINGS

It is believed that the invention will be better understood from the following description in conjunction with the accompanying drawings in which.

DETAILED DESCRIPTION OF THE INVENTION

The Cleaning Composition

Figure 2:
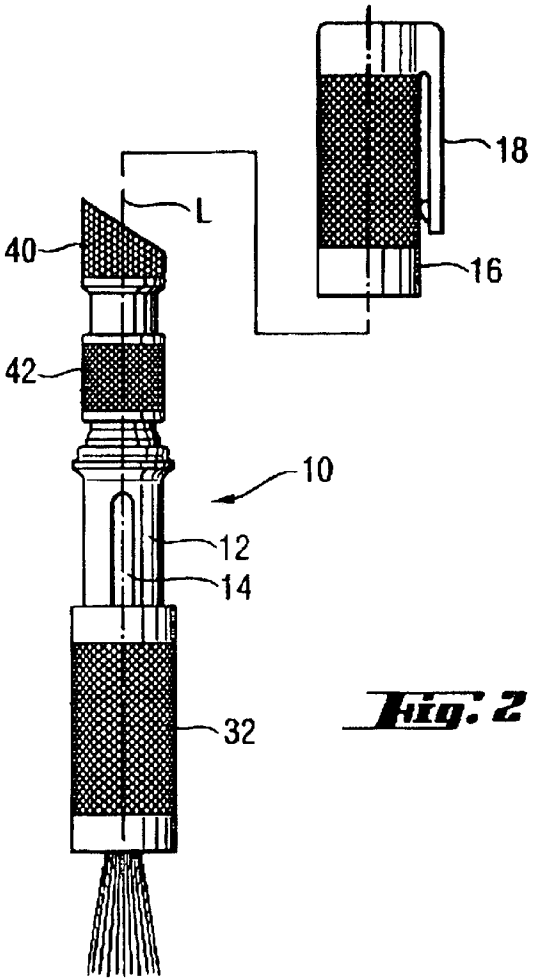
FIG. 2 is a side view of a preferred applicator according to the present invention shown in its usage configuration.

To allow a more detailed and clear description of the present invention, in the following paragraphs firstly a number of terms, as used herein, will be defined.

The term "fluorinated carbon compound", as used herein, denotes any compound comprising organic molecules each molecule comprising at least one carbon atom, at least one hydrogen atom and at least one fluorine atom.

The term "perfluorinated carbon compound", as used herein, denotes any fluorinated carbon compound in which the ratio of fluorine atoms to hydrogen atoms is at least 1:1, preferably 5:1, more preferably 10:1, most preferably 20:1. The term "perfluorinated carbon compound", as used herein, is meant to comprise any of the compounds sometimes referred to as "partially fluorinated carbon compounds" or "semi-fluorinated carbon compounds".

The term "perfluoropolyether", as used herein, denotes a perfluorinated carbon compound with one or more etheric functionalities in the form $CF_xR_y$—O—$CF_{x'}R'_{y'}$ where x+y=x'+y'=3 and R and R', each independently, may be either a fluorine atom or a perfluorinated carbon compound. Examples of perfluoropolyethers compounds include those of the general formula $$X—O—(C_3F_6O)_p—(C_2F_4O)_q—(CF_2O)_r—Y$$

wherein:

- the groups $(C_3F_6O)$, $(C_2F_4O)$ and $(CF_2O)$ can appear in the above sequence or randomly distributed in the chain;
- the groups $(C_3F_6O)$, $(C_2F_4O)$ and $(CF_2O)$ can be linear or branched;
- p can vary from 0 to 300, q can vary from 0 to 300, r can vary from 0 to 300, and at least one of p, q, and r is different from zero;
- X and Y can be the same or different from each other and are perfluoroalkyl chains, preferably containing 1 to 3 carbon atoms.

The term "H-terminated perfluoropolyether", as used herein, denotes a perfluorinated carbon compound with one or more etheric functionalities in the form $CF_xR_y$—O—$CF_{x'}R'_{y'}$ where x+y=x'+y'=3 and R and R', each independently may be a fluorine atom, a hydrogen atom or a perfluorinated carbon compound. Examples of perfluoropolyethers compounds include those of the general formula $$X—O—(C_3F_6O)_p—(C_2F_4O)_q—(CF_2O)_r—Y$$

wherein:

- the groups $(C_3F_6O)$, $(C_2F_4O)$ and $(CF_2O)$ can appear in the above sequence or randomly distributed in the chain;
- the groups $(C_3F_6O)$, $(C_2F_4O)$ and $(CF_2O)$ can be linear or branched, and linear or branched groups corresponding to the same brute formula can be present at the same time on the same molecule;
- p can vary from 0 to 300, q can vary from 0 to 300, r can vary from 0 to 300, and at least one of p, q, and r is different from zero;
- X and Y can be the same or different from each other and are fluoroalkyl chains each of which contains preferably 1 to 3 carbon atoms and at least one hydrogen atom, preferably one.

The above structures for "perfluoropolyethers" and "H-terminated perfluoropolyethers" are only provided as non-limiting examples and in principle any other perfluoropolyether and mixtures thereof, preferably liquid, can be used in the formulations according to the present invention. Other typical structures are described for example in EP 0,165,650 B1; EP 0,621,298 A2; U.S. Pat. Nos. 3,242,218; 3,665,041; 3,715,378; 3,810,874.

The term "electrosafe", as used herein, denotes a liquid formulation with a dielectric constant of less than 30, preferably less than 25, more preferably less than 20, yet more preferably less than 15, even more preferably less than 12, yet even more preferably less than 10, most preferably less than 8.

The term "household or office equipment", as used herein, denotes all devices to be used in a household or business environment and all devices sold to consumers. The term "electronic household or office equipment", as used herein, denotes all household and office equipment which comprises an electronic circuit.

The term pen-shaped, as used herein, denotes a shape which can be thought as comprised by a cylinder, which has a height of less than 50 cm, preferably less than 30 cm, more preferably less than 20 cm, most preferably less then 15 cm and a height to diameter ratio of more than about 3:1, more preferably more than about 5:1, yet more preferably more than about 7:1, most preferably about 10:1.

The term "dust and dirt" comprises any organic or inorganic material deposited on an item, which is not wanted there, in particular for reasons of cleanness and hygiene.

Any composition which comprises at least one fluorinated carbon compound and which can be used for cleaning purposes can be used as the composition of the present invention. Preferred compositions comprise at least one perfluorinated carbon compound and/or preferably at least one perfluoropolyether and/or more preferably H-terminated perfluoropolyether.

Preferred perfluoropolyethers and H-terminated perfluoropolyethers are available on the market, e.g. from Ausimont, Italy, under the tradenames Galden HT200, Galden D02, Galden D100, H-Galden, "grado B", H-Galden "grado C" and H-Galden "grado D", the H-Galden products being the more preferred ones.

The preferred fluorinated carbon compounds possess excellent cleaning properties. For example, it has been found that a very small amount of cleaning composition, about 0.5 ml, suffices to clean the screen of a portable computer from dust, soil, grease, finger marks and the like giving the screen the visual appearance of high cleanness. It also has been observed, that the cleaned computer screen is less easily re-soiled, namely by fingermarks.

These compounds are preferred also for a number of further relevant benefits, which in part contribute to the excellent cleaning results and in part are independent additional benefits:

The preferred fluorinated carbon compounds exhibit excellent lubrication properties. Excellent lubrication promotes the even spreading of the cleaning composition and facilitates rubbing by a sponge, wipe or other implement. This allows the use of low amounts of cleaning composition and makes it easier to reach portions of equipment which are difficult to access.

Further, the cleaning composition of the present invention has been found to impart shine to the cleaned surfaces. Especially for plastic surfaces the cleaning in combination with the achieved shine gives the impression of a surface renewal.

The cleaning composition of the present invention are preferably electro-safe. Hence, even when the cleaning composition comes in contact with electric or electronic parts the composition—as opposed to most other cleaning compositions and liquids—will not induce a short-circuit or any other damage—even while the parts are connected to a power supply and electric currents are present. This makes the cleaning composition safe to use on expensive and delicate equipment and is highly reassuring to the consumer.

In another aspect, the cleaning composition of the present invention is environmentally friendly. Electro-safe compounds often comprise chlorinated compounds, which are known to contribute to the ozone depletion of the ozonosphere and further to the concerning effect known as global warming. The preferred perfluoropolyethers and in particular the H-terminated perfluoropolyethers of the present invention are substantially chlorine-free and are believed to have an ozone depletion potential of zero.

The cleaning composition according to the present invention in a further aspect are safe to use from a health point of view and in particular are skin safe, which is important when such cleaning composition are used by a variety of consumers, including very young and very old ones.

In another aspect, the cleaning compositions according to the present invention may provide a low flammability risk, which is key for a cleaning composition to be used on devices which may contain live electric or electronic circuits, to be marketed to a variety of consumers, and to be used and stored in a great variety of circumstances and locations.

In addition to the foregoing considerations, the compositions used herein are preferably formulated such that they are easily dispensed and are not so viscous or self-adhesive in nature that they render the cleaning applicator (10) unhandy or difficult to use. Preferably the cleaning compositions described herein are formulated as liquid cleaning compositions. In one alternative they may be provided as a gel. A preferred cleaning composition according to the present invention comprises:

A. Fluorinated carbon compounds—The compositions herein may comprise any suitable amount of fluorinated carbon compounds, including from about 0.001% to about 99.99%, preferably from about 1% to about 98%, more preferably from about 20% to about 96% of fluorinated carbon compounds, most preferably H-terminated perfluoropolyethers.

B. Solvents—The compositions herein may comprise any suitable amount of solvents, including from about 0.01% to about 40% of solvents, preferably from about 0.1% to about 30%, more preferably from about 0.2% to about 20%. Preferred solvents are non-fluorinated solvents including organic carbon compounds comprising the classes of: alcohols; glycols; polyalcohols; ethers; polyethers; ketones; paraffins; saturated or unsaturated, linear or branched or cyclic hydrocarbons; esters; and mixtures thereof. Each of the above functionalities can be present at the same time and/or several times on the same solvent molecule. Examples are methanol, ethanol, propanol, isopropyl alcohol, ethyl lactate, propylene glycol propyl ether, propylen glycol mono butyl ether, 2-butoxy ethanol, 2-(2-butoxyethoxy) ethanol, $C_9$–$C_{12}$ isoalkanes, and mixtures thereof.

C. Optionals—The compositions herein may comprise minor amounts of various optional ingredients, including surfactants, oils, preservatives, anti-static agents, fragrances, odor absorbing components, and the like, and mixtures thereof. The optional ingredients may be included in any suitable amount. If used, such optional ingredients will typically comprise from about 0.0001% to about 50%, preferably from about 0.001% to about 25%, more preferably from about 0.01% to about 20%, by weight, of the cleaning composition. Preferred optionals are namely the following:

1. Surfactants—Surfactants Include Non-ionic, Anionic, Cationic, Ampholytic, Zwitterionic Surfactants, and Mixtures Thereof.

a. Nonionic Surfactants

The nonionic surfactants which can be used in the present invention may comprise essentially any alkoxylated nonionic surfactant and mixtures thereof. The ethoxylated and propoxylated nonionic surfactants are preferred. Preferred alkoxylated surfactants can be selected from the classes of the nonionic condensates of alkyl phenols, nonionic ethoxylated alcohols, nonionic ethoxylated/propoxylated fatty alcohols, non ionic ethoxylate/propoxylate condensates with propylene glycol, and the nonionic ethoxylate condensation products with propylene oxide/ethylene diamine adducts. Highly preferred are nonionic alkoxylated alcohol surfactants, being the condensation products of aliphatic alcohols with from 1 to 125 moles of alkylene oxide, in particular about 50 or from 1 to 15 moles, preferably to 11 moles, particularly ethylene oxide and/or propylene oxide, are highly preferred nonionic surfactant comprised in the anhydrous component of the composition of the invention. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 9 moles and in particular 3, 5 or 7 moles, of ethylene oxide per mole of alcohol.

The nonionic surfactant which can be used in the present invention may also comprise polyhydroxy fatty acid amides, in particular those having the structural formula $R^2CONR^1Z$ wherein: R1 is H, $C_{1-18}$, preferably $C_1$–$C_4$ hydrocarbyl, 2-hydroxy ethyl, 2-hydroxy propyl, ethoxy, propoxy, or a mixture thereof, preferably C1–C4 alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ or $C_7$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. A preferred nonionic polyhydroxy fatty acid amide surfactant for use herein is a $C_{12}$–$C_{14}$, a $C_{15}$–$C_{17}$ and/or $C_{16}$–$C_{18}$ alkyl N-methyl glucamide. It may be particularly preferred that the composition herein comprises a mixture of a $C_{12}$–$C_{18}$ alkyl N-methyl glucamide and condensation products of an alcohol having an alkyl group containing from 8 to 20 carbon atoms with from 2 to 9 moles and in particular 3, 5 or 7 moles, of ethylene oxide per mole of alcohol. The polyhydroxy fatty acid amide can be prepared by any suitable process. One particularly preferred process is described in detail in WO 9206984. A product comprising about 95% by weight polyhydroxy fatty acid amide, low levels of undesired impurities such as fatty acid esters and cyclic amides, and which is molten typically above about 80° C., can be made by this process.

The nonionic surfactant for use in the present invention may also comprise a fatty acid amide surfactant or alkoxylated fatty acid amide. They include those nonionic surfactants having the formula: $R^6CON(R^7)(R^8)$ wherein $R^6$ is an alkyl group containing from 7 to 21, preferably from 9 to 17 carbon or even 11 to 13 carbon atoms and $R^7$ and $R^8$ are each individually selected from the group consisting of hydrogen, $C_1$–$C_4$ alkyl, $C_1$–$C_4$ hydroxyalkyl, and —$(C_2H_4O)_xH$, where x is in the range of from 1 to 11, preferably 1 to 7, whereby it may be preferred that $R^7$ is different to $R^8$, one having x being 1 or 2, one having x being from 3 to 11 or preferably from 3 to 7.

The nonionic surfactant for use in the present invention may also comprise an alkyl ester of a fatty acid. These nonionic surfactants include those having the formula: $R^9COO(R^{10})$ wherein $R^9$ is an alkyl group containing from 7 to 21, preferably from 9 to 17 carbon or even 11 to 13 carbon atoms and $R^{10}$ is a $C_1$–$C_4$ alkyl, $C_1C_4$ hydroxyalkyl, or —$(C_2H_4O)_xH$, where x is in the range of from 1 to 11, preferably from 1 to 7, more preferably from 1 to 5, whereby it may be preferred that $R^{10}$ is a methyl or ethyl group.

The nonionic surfactant for use in the present invention may also comprise an alkylpolysaccharide, such as those disclosed in U.S. Pat. No. 4,565,647, Llenado, issued Jan. 21, 1986, having a hydrophobic group containing from 6 to 30 carbon atoms and a polysaccharide, e.g., a polyglycoside, hydrophilic group containing from 1.3 to 10 saccharide units.

Preferred alkylpolyglycosides have the formula $$R^2O(C_nH_{2n}O)t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl is preferably derived from glucose.

Also suitable as nonionic surfactants for the purpose of the present invention are the semi-polar nonionic surfactants: Semi-polar nonionic surfactants are a special category of nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Semi-polar nonionic detergent surfactants include the amine oxide surfactants having the formula $$R^3(OR^4)xN(\overset{O}{\uparrow}R^5)2$$

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{12}$ alkoxy ethyl dihydroxy ethyl amine oxides.

Also suitable as nonionic surfactants for the purpose of the present invention are the co-surfactant selected from the group of primary or tertiary amines. Suitable primary amines for use herein include amines according to the formula $R_1NH_2$ wherein $R_1$ is a $C_6$–$C_{12}$, preferably $C_6$–$C_{10}$ alkyl chain or $R_4X(CH_2)_n$, X is —O—, —C(O)NH— or —NH—, $R_4$ is a $C_6$–$C_{12}$ alkyl chain n is between 1 to 5, preferably 3. $R_1$ alkyl chains may be straight or branched and may be interrupted with up to 12, preferably less than 5 ethylene oxide moieties.

Preferred amines according to the formula herein above are n-alkyl amines. Suitable amines for use herein may be selected from 1-hexylamine, 1-octylamine, 1-decylamine and laurylamine. Other preferred primary amines include C8–C10 oxypropylamine, octyloxypropylamine, 2-ethylhexyl-oxypropylamine, lauryl amido propylamine and amido propylamine.

Suitable tertiary amines for use herein include tertiary amines having the formula $R_1R_2R_3N$ wherein R1 and R2 are $C_1$–$C_8$ alkylchains or $$—(CH_2—\overset{R_5}{\overset{|}{C}}H—O)_xH$$

$R_3$ is either a $C_6$–$C_{12}$, preferably $C_6$–$C_{10}$ alkyl chain, or $R_3$ is $R_4X(CH_2)_n$, whereby X is —O—, —C(O)NH— or —NH—, $R_4$ is a $C_4$–$C_{12}$, n is between 1 to 5, preferably 2–3. $R_5$ is H or $C_1$–$C_2$ alkyl and x is between 1 to 6. $R_3$ and $R_4$ may be linear or branched; $R_3$ alkyl chains may be interrupted with up to 12, preferably less than 5, ethylene oxide moieties.

Preferred tertiary amines are $R_1R_2R_3N$ where R1 is a C6–C12 alkyl chain, R2 and R3 are C1–C3 alkyl or

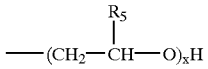

where R5 is H or CH3 and x=1–2.

Also preferred are the amidoamines of the formula:

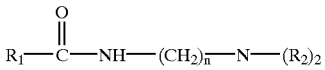

wherein $R_1$ is $C_6$–$C_{12}$ alkyl; n is 2–4, preferably n is 3; $R_2$ and $R_3$ is $C_1$–$C_4$ Most preferred amines of the present invention include 1-octylamine, 1-hexylamine, 1-decylamine, 1-dodecylamine, C8–10oxypropylamine, N coco 1-3diaminopropane, coconutalkyldimethylamine, lauryldimethylamine, lauryl bis(hydroxyethyl)amine, coco bis(hydroxyehtyl)amine, lauryl amine 2 moles propoxylated, octyl amine 2 moles propoxylated, lauryl amidopropyldimethylamine, C8–10 amidopropyldimethylamine and C10 amidopropyldimethylamine.

The most preferred amines for use herein are 1-hexylamine, 1-octylamine, 1-decylamine, 1-dodecylamine. Especially desirable are n-dodecyldimethylamine and bishydroxyethylcoconutalkylamine and oleylamine 7 times ethoxylated, lauryl amido propylamine and cocoamido propylamine.

When included therein, the cleaning composition of the present invention typically comprises from 0.01% to about 40%, preferably from about 0.1% to about 15% by weight of such nonionic surfactants, and mixtures thereof.

b. Anionic Surfactants

Suitable anionic surfactants to be used are linear alkyl benzene sulfonate, alkyl ester sulfonate surfactants including linear esters of $C_8$–$C_{20}$ carboxylic acids (i.e., fatty acids) which are sulfonated with gaseous $SO_3$ according to "The Journal of the American Oil Chemists Society", 52 (1975), pp. 323–329. Suitable starting materials would include natural fatty substances as derived from tallow, palm oil, etc.

The preferred alkyl ester sulfonate surfactants comprise alkyl ester sulfonate surfactants of the structural formula:

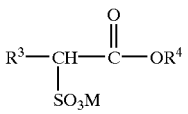

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{10}$–$C_{16}$ alkyl.

Other suitable anionic surfactants include the alkyl sulfate surfactants which are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g. sodium, potassium, lithium), or ammonium or substituted ammonium (e.g. methyl-, dimethyl-, and trimethyl ammonium cations and quaternary ammonium cations such as tetramethyl-ammonium and dimethyl piperdinium cations and quaternary ammonium cations derived from alkylamines such as ethylamine, diethylamine, triethylamine, and mixtures thereof, and the like). Typically, alkyl chains of $C_{12}$–$C_{16}$ are preferred.

Other anionic surfactants can also be included in the present invention. These can include salts (including, for example, sodium, potassium, ammonium, and substituted ammonium salts such as mono-, di- and triethanolamine salts) of soap, $C_8$–$C_{22}$ primary of secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl glycerol sulfonates, fatty acyl glycerol sulfonates, fatty oleyl glycerol sulfates, alkyl phenol ethylene oxide ether sulfates, paraffin sulfonates, alkyl phosphates, alkylpolyglycoletherphosphates, isethionates such as the acyl isethionates, N-acyl taurates, alkyl succinamates and sulfosuccinates, monoesters of sulfosuccinates (especially saturated and unsaturated $C_{12}$–$C_{18}$ monoesters) and diesters of sulfosuccinates (especially saturated and unsaturated $C_6$–$C_{12}$ diesters), acyl sarcosinates, sulfates of alkylpolysaccharides such as the sulfates of alkylpolyglucoside (the nonionic nonsulfated compounds being described below), branched primary alkyl sulfates, and alkyl polyethoxy carboxylates such as those of the formula $RO(CH_2CH_2O)_k$—$CH_2COO$—M+ wherein R is a $C_8$–$C_{22}$ alkyl, k is an integer from 1 to 10, and M is a soluble salt-forming cation. Resin acids and hydrogenated resin acids are also suitable, such as rosin, hydrogenated rosin, and resin acids and hydrogenated resin acids present in or derived from tall oil.

Further examples are described in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

Highly preferred anionic surfactants include alkyl alkoxylated sulfate surfactants which are water soluble salts or acids of the formula $RO(A)_mSO3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl, trimethylammonium cations and quaternary ammonium cations such as tetramethyl-ammonium and dimethyl piperdinium cations and those derived from alkylamines such as ethylamine, diethylamine, triethylamine, mixtures thereof, and the like. Exemplary surfactants are $C_{12}$–$C_{18}$ alkyl polyethoxylate (1.0) sulfate ($C_{12}$–$C_{18}$E(1.0)M), $C_{12}$–$C_{18}$ alkyl polyethoxylate (2.25) sulfate ($C_{12}$–$C_{18}$E(2.25)M), $C_{12}$–$C_{18}$ alkyl polyethoxylate (3.0) sulfate ($C_{12}$–$C_{18}$E(3.0)M), and $C_{12}$–$C_{18}$ alkyl polyethoxylate (4.0) sulfate ($C_{12}$–$C_{18}$E(4.0)M), wherein M is conveniently selected from sodium and potassium.

Furthermore, anionic surfactants suitable for application in the present invention are fluorinated anionic surfactants, such as perfluoroalkyl sulphates, perfluoroalkyl carboxylates, perfluoroalkyl phosphates, perfluoroalkyl sulphonates, as well as their homologs where an ethylene spacer —CH2—CH2— is present between the anionic group and the perfluoroalkyl chain.

When included therein, the cleaning composition of the present invention typically comprises from 0.01% to about 40%, preferably from about 0.1% to about 15% by weight of such anionic surfactants, and mixtures thereof.

c. Cationic Surfactants

Basically any cationic surfactants are suitable for use in the present invention. Examples of such cationic surfactants include the ammonium surfactants such as alkyltrimethylammonium halogenides, and those surfactants having the formula:

$$[R^2(OR^3)_y][R^4(OR^3)_y]_2R^5N+X—$$

wherein $R^2$ is an alkyl or alkyl benzyl group having from about 8 to about 18 carbon atoms in the alkyl chain, each $R^3$ is selected from the group consisting of —$CH_2CH_2$—, —$CH_2CH(CH_3)$—, —$CH_2CH(CH_2OH)$, —$CH_2CH_2CH_2$—, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, —$CH_2CHOH$—$CHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

A quaternary ammonium surfactant suitable for use in the present invention has the formula (I):

Formula I

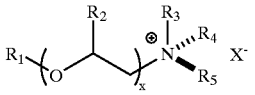

whereby R1 is a short chainlength alkyl (C6–C10) or alkylamidoalkyl of the formula (II):

Formula II

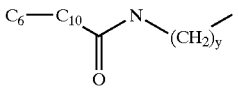

y is 2–4, preferably 3.

whereby R2 is H or a C1–C3 alkyl, whereby x is 0–4, preferably 0–2, most preferably 0, whereby R3, R4 and R5 are either the same or different and can be either a short chain alkyl (C1–C3) or alkoxylated alkyl of the formula III, whereby $X^-$ is a counterion, preferably a halide, e.g. chloride or methylsulfate.

Formula III

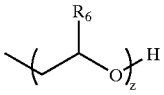

R6 is $C_1$–$C_4$ and z is 1 or 2.

Preferred quat ammonium surfactants are those as defined in formula I whereby $R_1$ is $C_8$, $C_{10}$ or mixtures thereof, x=o, $R_3$, $R_4$=$CH_3$ and $R_5$=$CH_2CH_2OH$.

Highly preferred cationic surfactants are the water-soluble quaternary ammonium compounds useful in the present composition having the formula:

$$R_1R_2R_3R_4N^+X^- \quad \text{(i)}$$

wherein $R_1$ is $C_8$–$C_{16}$ alkyl, each of $R_2$, $R_3$ and $R_4$ is independently $C_1$–$C_4$ alkyl, $C_1$–$C_4$ hydroxy alkyl, benzyl, and —$(C_2H_{40})_xH$ where x has a value from 2 to 5, and X is an anion. Not more than one of $R_2$, $R_3$ or $R_4$ should be benzyl.

The preferred alkyl chain length for $R_1$ is $C_{12}$–$C_{15}$ particularly where the alkyl group is a mixture of chain lengths derived from coconut or palm kernel fat or is derived synthetically by olefin build up or OXO alcohols synthesis. Preferred groups for $R_2R_3$ and $R_4$ are methyl and hydroxyethyl groups and the anion X may be selected from halide, methosulphate, acetate and phosphate ions.

Examples of suitable quaternary ammonium compounds of formulae (i) for use herein are:

coconut trimethyl ammonium chloride or bromide;

coconut methyl dihydroxyethyl ammonium chloride or bromide;

decyl triethyl ammonium chloride;

decyl dimethyl hydroxyethyl ammonium chloride or bromide;

$C_{12}$-$_{15}$ dimethyl hydroxyethyl ammonium chloride or bromide;

coconut dimethyl hydroxyethyl ammonium chloride or bromide;

myristyl trimethyl ammonium methyl sulphate;

lauryl dimethyl benzyl ammonium chloride or bromide;

lauryl dimethyl $(ethenoxy)_4$ ammonium chloride or bromide;

choline esters (compounds of formula (i) wherein $R_1$ is $CH_2$—$CH_2$—O—C(=O)—$C_{12-14}$ alkyl and $R_2R_3R_4$ are methyl).

di-alkyl imidazolines [compounds of formula (i)].

Other cationic surfactants useful herein are also described in U.S. Pat. No. 4,228,044, Cambre, issued Oct. 14, 1980 and in European Patent Application EP 000,224.

Typical cationic surfactant components include the water-insoluble quaternary-ammonium actives or their corresponding amine precursor, the most commonly used having been di-long alkyl chain ammonium chloride or methyl sulfate.

Preferred cationic surfactants among these include the following:

1) ditallow dimethylammonium chloride (DTDMAC);

2) dihydrogenated tallow dimethylammonium chloride;

3) dihydrogenated tallow dimethylammonium methylsulfate;
4) distearyl dimethylammonium chloride;
5) dioleyl dimethylammonium chloride;
6) dipalmityl hydroxyethyl methylammonium chloride;
7) stearyl benzyl dimethylammonium chloride;
8) tallow trimethylammonium chloride;
9) hydrogenated tallow trimethylammonium chloride;
10) $C_{12-14}$ alkyl hydroxyethyl dimethylammonium chloride;
11) $C_{12-18}$ alkyl dihydroxyethyl methylammonium chloride;
12) di(stearoyloxyethyl) dimethylammonium chloride (DSOEDMAC);
13) di(tallow-oxy-ethyl) dimethylammonium chloride;
14) ditallow imidazolinium methylsulfate;
15) 1-(2-tallowylamidoethyl)-2-tallowyl imidazolinium methylsulfate.

Biodegradable quaternary ammonium compounds have been presented as alternatives to the traditionally used di-long alkyl chain ammonium chlorides and methyl sulfates. Such quaternary ammonium compounds contain long chain alk(en)yl groups interrupted by functional groups such as carboxy groups. Said materials are disclosed in numerous publications such as EP-A-0,040,562, and EP-A-0,239,910.

The quaternary ammonium compounds and amine precursors herein have the formula (I) or (II), below:

(I)

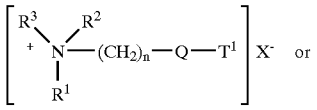

(II)

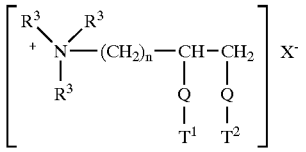

wherein Q is selected from —O—C(O)—, —C(O)—O—, —O—C(O)—O—, —$NR^4$—C(O)—, —C(O)—$NR^4$—;

$R^1$ is $(CH_2)_n$—Q—$T^2$ or $T^3$;

$R^2$ is $(CH_2)_m$—Q—$T^4$ or $T^5$ or $R^3$;

$R^3$ is $C_1$–$C_4$ alkyl or $C_1$–$C_4$ hydroxyalkyl or H;

$R^4$ is H or $C_1$–$C_4$ alkyl or $C_1$–$C_4$ hydroxyalkyl;

$T^1$, $T^2$, $T^3$, $T^4$, $T^5$ are independently $C_{11}$–$C_{22}$ alkyl or alkenyl;

n and m are integers from 1 to 4; and $X^-$ is a compatible anion. Non-limiting examples of compatible anions include chloride or methyl sulfate.

The alkyl, or alkenyl, chain $T^1$, $T^2$, $T^3$, $T^4$, $T^5$ must contain at least 11 carbon atoms, preferably at least 16 carbon atoms. The chain may be straight or branched. Tallow is a convenient and inexpensive source of long chain alkyl and alkenyl material. The compounds wherein $T^1$, $T^2$, $T^3$, $T^4$, $T^5$ represents the mixture of long chain materials typical for tallow are particularly preferred.

Specific examples of quaternary ammonium compounds suitable for use herein include:

1) N,N-di(tallowyl-oxy-ethyl)-N,N-dimethyl ammonium chloride;
2) N,N-di(tallowyl-oxy-ethyl)-N-methyl, N-(2-hydroxyethyl) ammonium methyl sulfate;
3) N,N-di(2-tallowyl-oxy-2-oxo-ethyl)-N,N-dimethyl ammonium chloride;
4) N,N-di(2-tallowyl-oxy-ethylcarbonyl-oxy-ethyl)-N,N-dimethyl ammonium chloride;
5) N-(2-tallowyl-oxy-2-ethyl)-N-(2-tallowyl-oxy-2-oxo-ethyl)-N, N-dimethyl ammonium chloride;
6) N,N,N-tri(tallowyl-oxy-ethyl)-N-methyl ammonium chloride;
7) N-(2-tallowyl-oxy-2-oxo-ethyl)-N-(tallowyl-N,N-dimethyl-ammonium chloride; and
8) 1,2-ditallowyl-oxy-3-trimethylammoniopropane chloride; and mixtures of any of the above materials.

Other cationic surfactants suitable for application in the present invention are fluorinated cationic surfactants, such as perfluoroalkyl ammonium surfactants, as well as their homologs where an ethylene spacer —CH2—CH2— is present between the ionic group and the perfluoroalkyl chain.

When included therein, the cleaning composition of the present invention typically comprises from 0.01% to about 40%, preferably from about 0.1% to about 15% by weight of such cationic surfactants, and mixtures thereof.

d. Ampholytic Surfactants

Ampholytic surfactants are also suitable for use in the present invention. These surfactants can be broadly described as aliphatic derivatives of secondary or tertiary amines, or aliphatic derivatives of heterocyclic secondary and tertiary amines in which the aliphatic radical can be straight- or branched-chain. One of the aliphatic substituents contains at least about 8 carbon atoms, typically from about 8 to about 18 carbon atoms, and at least one contains an anionic water-solubilizing group, e.g. carboxy, sulfonate, sulfate. See U.S. Pat. No. 3,929,678 to Laughlin et al., issued Dec. 30, 1975 at column 19, lines 18–35, for examples of ampholytic surfactants.

Other ampholytic surfactants suitable for application in the present invention are fluorinated ampholytic surfactants.

When included therein, the cleaning composition of the present invention typically comprises from 0.01% to about 40%, preferably from about 0.1% to about 15% by weight of such ampholytic surfactants, and mixtures thereof.

e. Zwitterionic Surfactants

Zwitterionic surfactants are also suitable for use herein. These surfactants can be broadly described as derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975 at column 19, line 38 through column 22, line 48, for examples of zwitterionic surfactants.

Other zwitterionic surfactants suitable for application in the present invention are fluorinated zwitterionic surfactants.

When included therein, the cleaning composition of the present invention typically comprises from 0.1% to about 40%, preferably from about 0.1% to about 15% by weight of such zwitterionic surfactants, and mixtures thereof.

Preferred surfactants include nonionic surfactants, in particular fluorinated or perfluorinated nonionic surfactants and anionic surfactants, in particular fluorinated or perfluorinated anionic surfactants, and mixtures thereof.

2. Oils

Other suitable classes of ingredients to be used in the proposed cleaning composition are oils or in general any hydrophobic liquid substance that is completely or partially immiscible with water.

Oils would represent a hydrophobic part of the cleaning composition, particularly suitable for absorption of hydrophobic gaseous pollutants such as volatile aromatic compounds. Oils can be for instance emulsified or microemulsified by a number of methods that are well known in the art.

Examples of oils suitable for the current applications are: paraffins (linear or branched hydrocarbons, e.g. squalane), fatty acids (oleic, palmitic, stearic, linoleic) and their gylcerides, natural oils (palm oil, coconut oil, linseed oil, castor oil, cotton seed oil, soybean oil), and mixtures thereof.

When included therein, the cleaning composition of the present invention typically comprises from 0.001% to about 40%, preferably from about 0.01% to about 20%, most preferably from 0.1% to about 15% by weight of such oils.

3. Anti-static Agents

Highly preferred cleaning compositions according to the present invention comprise an anti-static agent. If used, such anti-static agents will typically comprise 0.001% to 8%, by weight, of the compositions, preferably from 0.01% to 5%, by weight, of the compositions. Preferred anti-static agents include the series of sulfonated polymers available as VERSAFLEX 157, 207, 1001, 2004 and 7000, from National Starch and Chemical Company and polymeric surfactants such as Crodastat 100 and 200 from Croda, and mixtures thereof. Anti-static agents include also poly (ethylene glycol) laurates, poly (ethylene glycol) oleates, fatty amides, and mixtures thereof.

4. Fragrances/Perfumes

The cleaning composition of the present invention can also optionally provide a "scent signal" in the form of a pleasant odor which signals the removal of malodor from equipment. The scent signal is designed to provide a fleeting perfume scent, and is not designed to be overwhelming or to be used as an odor masking ingredient. When perfume is added as a scent signal, it is added only at very low levels, e.g., from 0% to 1.0%, preferably from 0.003% to 0.3%, more preferably from 0.005% to 0.2%, by weight of the cleaning composition.

When stronger levels of perfume are preferred, relatively higher levels of perfume can be added. Any type of perfume can be incorporated into the composition of the present invention.

5. Antimicrobials

The compositions of the present invention may further comprise antimicrobials. Preferred antimicrobials are disinfectant and antiseptic compounds comprising the classes of: chlorine and chlorine compounds; iodine and iodine compounds; peroxygen compounds; ozone; alcohols; phenolic compounds; quaternary ammonium antimicrobial compounds; surface-active agents: acid-anionic compounds, amphoteric compounds; chlorhexidine; nitrogen compounds; polymeric antimicrobial agents; mercury; organotin compounds; copper and zinc preservatives. Each of the above functionalities can be present at the same time and/or several times on the same antimicrobial molecule. Examples are: benzalkonium chlorides, substituted benzalkonium chlorides, cetylpyridinium chloride, N-(3-chloroallyl) hexaminium chloride, domiphen bromide, benzethonium chloride, methylbenzethonium chloride, sodium hypochlorite, chloroazodin, triiodomethane, peracetic acid, hydrogen peroxide, methyl alcohol, ethyl alcohol, phenylethyl alcohol, isopropyl alcohol, benzyl alcohol, phenol, p-chlorophenol, dodecyl benzene sulfonic acid, naphthalene sulfonic acid, 1,3,5,7-tetra-aza-adamantane hexamethylenetetramine, methylenebisthiocyanate, 4-pyridinemethanol, 2-mercaptobenzothiazole, 2-bromo-2nitro-1,3-propanediol, dodecylmorpholine-N-oxide, salicylanilide, dibenzpyridinetri-butyltin methacrylate-methyl methacrylates polymers, poly(hexamethylene-biguanide) hydrochloride, tricyclohexyltin hydroxide, bis (tributyltin) sulfide, and mixtures thereof. If used, such antimicrobials will typically comprise 0.001% to 8%, by weight, of the compositions, preferably from 0.01% to 5%, by weight, of the compositions.

6. Water

The compositions of the present invention may further comprise water. The compositions can comprise any suitable amount of water. If water is present, it is typically present at levels from 0% to 20%, preferably from 0.01% to 10%, more preferably from 0.1% to 8%, most preferably from 0.2% to 5%.

7. Odor Absorbing Components

The compositions of the present invention may further comprise an optional cyclodextrin, or zeolites, or other odor adsorbing components, and mixtures thereof. This will impart the composition with odor absorbing properties, which is especially useful for application on inanimate surfaces to control the malodor.

As used herein, the term "cyclodextrin" includes any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof. The preferred cyclodextrins are available, e.g., from Cerestar USA, Inc. and Wacker Chemicals (USA), Inc.

Typical levels of cyclodextrin in usage compositions for usage conditions are from 0.01% to 5%, preferably from 0.1% to 4%, more preferably from 0.2% to 2% by weight of the composition.

Examples of Cleaning Compositions

Having due regard to the foregoing considerations, the following illustrates preferred examples of cleaning compositions, but is not intended to be limiting thereof.

| A cleaning composition is formulated to comprise the following components (% denoted % by weight): | |
|---|---|
| Example 1: | |
| H-terminated perfluoropolyether ("H-Galden ZT 180" from Ausimont) | 85% |
| Isopropyl alcohol | 14.5% |
| Perfluorosurfactant Zonyl FSN100 (E. I. DuPont de Nemours and Company, Wilmington, Delaware, USA) | 0.49% |
| Perfume | 0.01% |
| Example 2: | |
| H-terminated perfluoropolyether ("H-Galden ZT 130" from Ausimont) | 94.6% |
| Ethyl lactate | 0.9% |
| Propylene glycol propyl ether | 0.9% |
| C9–12 isoalkanes ("Isopar G" from Exxon Mobil Corporation, Irviing, Texas, USA) | 2.0% |
| Perfluorosurfactant Zonyl FS 62 (DuPont) | 0.4% |
| Perfume | 0.01% |
| Water | 1.19% |
| Example 3: | |
| H-terminated perfluoropolyether ("H-Galden ZT 180" from Ausimont) | 94.6% |
| Ethyl lactate | 0.9% |
| Propylene glycol propyl ether | 0.9% |
| C9–12 isoalkanes ("Isopar G" from Exxon Mobil) | 2.0% |
| Perfluorosurfactant Zonyl FS 62 (DuPont) | 0.4% |
| Perfume | 0.01% |
| Water | 1.19% |

-continued

| A cleaning composition is formulated to comprise the following components (% denoted % by weight): | |
|---|---|
| Example 4: | |
| H-terminated perfluoropolyether ("H-Galden ZT 130" from Ausimont) | 92.4% |
| Ethyl lactate | 2.0% |
| Propylene glycol propyl ether | 2.0% |
| C9–12 isoalkanes ("Isopar G" from Exxon Mobil) | 2.0% |
| Perfluorosurfactant Zonyl FS 62 (DuPont) | 0.4% |
| Perfume | 0.01% |
| Water | 1.19% |
| Example 5: | |
| H-terminated perfluoropolyether ("H-Galden ZT 130" from Ausimont) | 96.6% |
| Ethyl lactate | 0.9% |
| Propylene glycol propyl ether | 0.9% |
| Perfluorosurfactant Zonyl FS 62 (DuPont) | 0.4% |
| Perfume | 0.01% |
| Water | 1.19% |

Application and Applicator

The compositions disclosed herein can be applied to surfaces in many different ways. For example, they may be poured from any suitable container onto the areas selected for treatment such as by bottles with sponge caps, spray bottles (operated by trigger or pressure or electrical or other means), brush, aerosol cans, drop-by-drop delivery systems, video and audio magnetic head cleaner in a cassette form or cleaning kit, etc.; a pad, wipe, pre-moistened wipe, towelette wipe, cloth or sponge made of any material, for example paper, a textile material, a non-woven material or open-cell or closed-cell foam may assist in the application of the cleaning composition, namely in the spreading of the composition and also in the removing of the composition.

Any integral or separate portion of the applicator (10) which is used to contact the object to be cleaned and to apply cleaning composition to it, is herein referred to as application device (40). While for some applicators (10) the application device (40) is integral with a storage device for the cleaning composition, one example being a wipe pre-moistured with a cleaning liquid, preferred applicators (10) according to the present invention comprise a application device (40) which is separate from a storage device and preferably in temporary or permanent liquid communication therewith.

More preferably an applicator (10) is used which allows for the application of a small and easily controlled amount of cleaning composition. Yet more preferably the applicator (10) also allows the user to spread the cleaning composition over a selected surface area. Most preferably the applicator (10) allows also for mechanical removal and collection of dust and dirt and of excess cleaning composition.

Suitable applicators (10) comprise containers, e.g. small plastic bottles, with a preferably small orifice, e.g. a nozzle, aerosol and pump spray applicators (10), pen-style applicators (10) comprising e.g. a nib. Highly preferred applicators (10) further comprise an integrated wiping surface and may comprise an additional brush (30).

Preferably the applicators (10) are portable and more preferably of a format which conveniently can be carried in a pocket or handbag, more preferred applicators (10) have a pen-shape, as defined above, and hence resemble in shape a fountain pen. Optionally the applicator (10) may comprise a clip (18).

Preferred applicators (10) according to the present invention comprise application devices (40) which exhibit a certain compression resistance and preferably also a certain ratio of the compression resistance to friction resistance.

The friction resistance of the application device (40) should be in a certain range, since a minimum friction is required for satisfactory mechanical removal of dust and dirt and a maximum friction should not be exceeded to ensure that the application device (40) can be comfortably moved or wiped over a surface. This range follows from the preferred compression resistance to friction resistance ratio specified below.

The compression resistance of the application device (40) is preferably also confined to a certain range: A compressible, i.e. soft application device (40) ensures comfortable usage and good conforming to the contours of the object to be cleaned (improving cleaning performance). Such good conforming to the contours of the object is particularly desirable when cleaning for example a keyboard where thorough cleaning can only be achieved if the application device (40) reaches into the recesses defined by protruding keys. A too compressible application device (40) on the other hand induces a risk that solid parts of the applicator (10), e.g. the sponge mounting (42) come into contact with the object to be cleaned and may induce damage such as scratches. Preferably the application device (40) exhibits a compression resistance from 0.1 kPa to 500 kPa, more preferably 0.5 kPa to 200 kPa, most preferably 1 kPa to 100 kPa.

According to the present invention it has surprisingly been found that the appropriate friction resistance should be selected in view of a given compression resistance, for example a very compressible application device (40) will typically be handled by a user without exerting much pressure and hence should have a sufficient friction resistance to ensure good mechanical dust and dirt removal. Highly preferred application devices (40) according to the present invention exhibit a ratio of compression resistance to friction resistance from 0.01 to 1, more preferably 0.02 to 0.7, most preferably 0.1 to 0.5.

Figure 1:
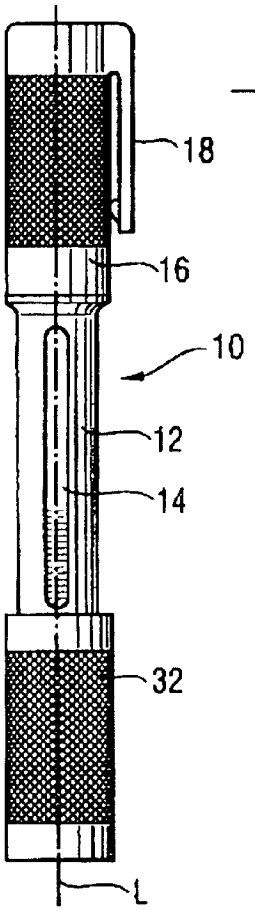
FIG. 1 is a side view of a preferred applicator according to the present invention shown in its configuration for transport and storage.
Figure 3:
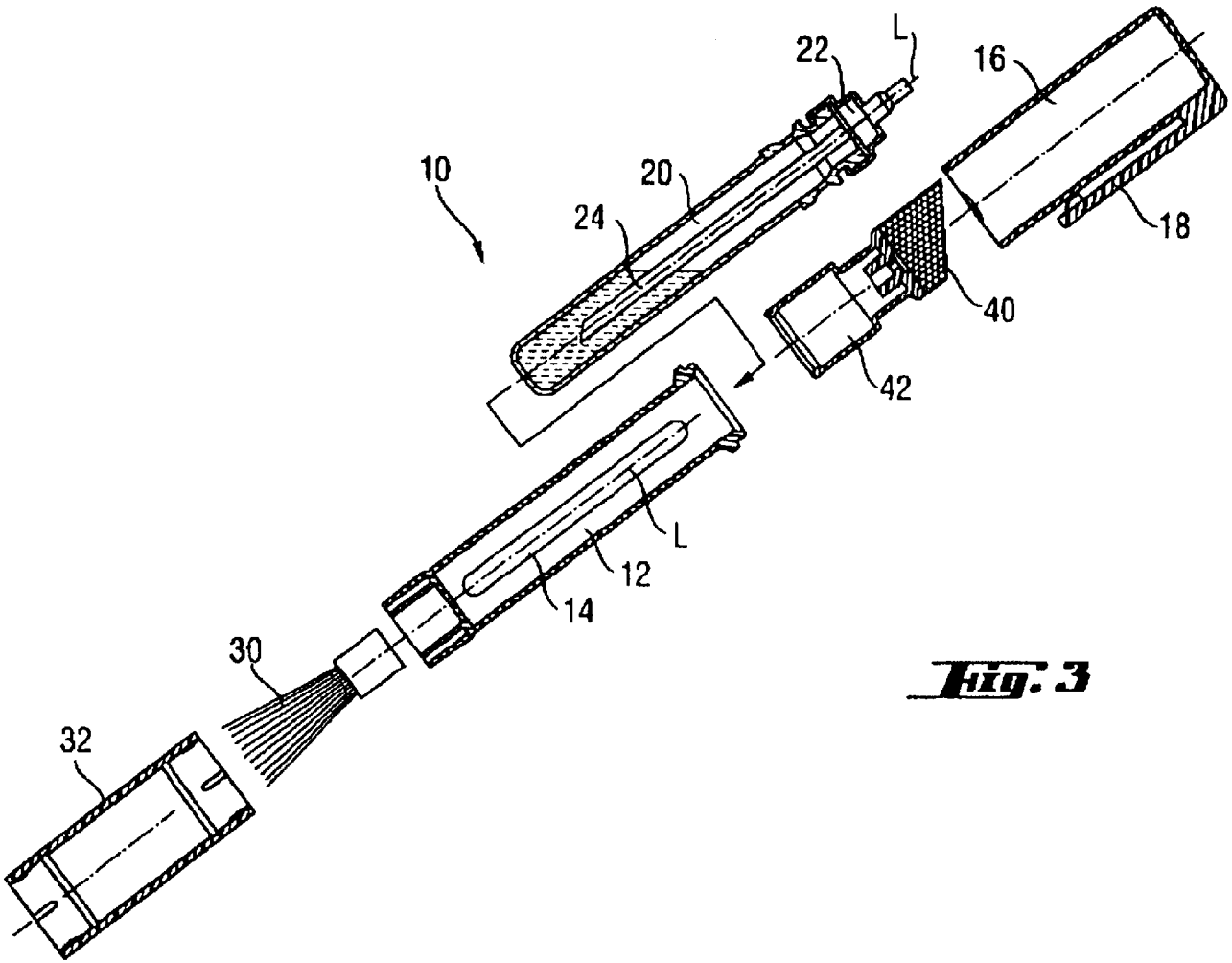
FIG. 3 is an exploded view of the preferred applicator shown in FIG. 1.
Figure 6A:
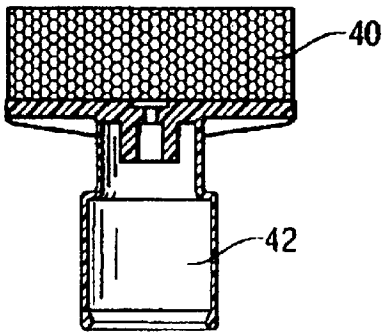
FIGS. 4*a* to 6*b* give cross sectional and top views of preferred sponges for the applicator of FIGS. 1 and 2.
Figure 6B:
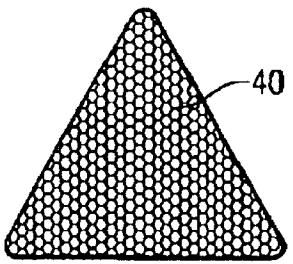
Figure 5A:
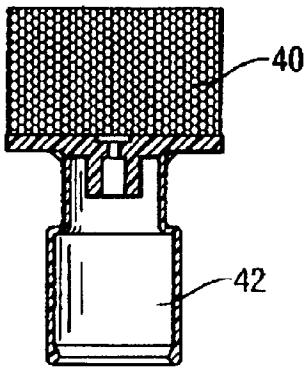
Figure 5B:
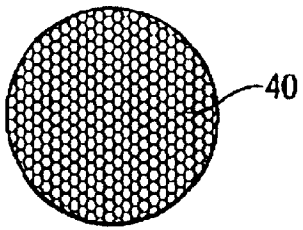
Figure 4A:
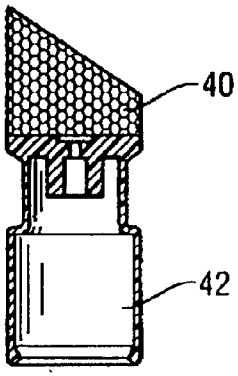
Figure 4B:
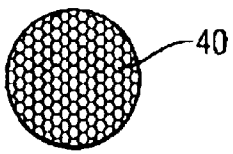

One non-limiting example of an applicator (10) according to the present invention is shown in FIGS. 1 to 3. As to be seen from these Figures, according to the present invention, a highly preferred applicator (10) will comprise a sponge (40). Most preferably such sponge (40) is releasably attached to the applicator (10), so that it can be replaced by another sponge (40). Preferably such sponge (40) is provided with a mounting (42) to make the releasable contact with the applicator (10). Replacement by another sponge (40) may be desired if a sponges (40) has acquired dirt. Such replacement may also be desired to use sponge (40) of different size and shape for different cleaning tasks. For example, a consumer may wish to use a large triangular sponge (40) for cleaning a TV set, but a small sponge (40) for cleaning a keyboard. Preferably the sponges (40) are replaced with their respective mountings.

It has been found that according to the present invention particularly preferred application devices (40) to be used on household and office equipment and preferably with an electrosafe cleaning composition, are application devices (40) with a tilted wiping surface. The term "tilted wiping surface" as used herein denotes a wiping surface which is tilted with regard to the plane perpendicular to the longitudinal axis. The longitudinal axis of an applicator (10) denotes the axis which is essentially parallel to the forearm of a user using the applicator (10) and which preferably is an axis of symmetry, L, of the applicator (10) as shown in FIG. 1 for a pen-shaped applicator (10). Tilt angles between 10° and 40° are preferred, tilt angles from 25° to 35° are most preferred. Such a tilted wiping surface has been found particularly useful for cleaning computer keyboards which typically are tilted with regard on the surface on which they stand.

It has been found that according to the present invention particularly preferred sponges (40) to be used on household and office equipment and preferably with an electrosafe cleaning composition, are application devices (40) comprising a straight edge. An application device (40) comprises a straight edge, as used herein, if the cross section of the application device (40) parallel with and adjacent to the wiping surface comprises a straight line, preferred application devices (40) comprising a straight edge according to the present invention has the form of a half-circle, a rectangle, a square, a triangle or an isosceles triangle, the latter being most preferred. Application devices (40) comprising a straight edge have been found particularly useful for the cleaning of larger surfaces e.g. TV sets and screens.

In one preferred embodiment of the present invention the applicator (10) is provided as a kit with a set of sponges (40), the set preferably comprising from two to five sponges (40). A highly preferred set of sponges (40) is shown in FIGS. 4*a* to 6*b*. This set comprises three sponges (40). A first sponge (40) has a cross-section (taken perpendicular to the longitudinal axis of the applicator (10)) which is essentially circular and has a diameter of about 16 mm (cf. FIG. 4*a*). This sponge (40) is not cut parallel to the plane perpendicular to the longitudinal axis but forms an angle of about 30° with this plane (cf. FIG. 4*b*). The sponge (40) has been found particularly useful for the cleaning of computer keyboards. A second sponge (40) is comprised which also has a circular cross-section (in the plane perpendicular to the longitudinal axis of the applicator (10)) and has a diameter of about 35 mm (cf. FIG. 5*a*). The wiping surface of this sponge (40) is essentially perpendicular to the longitudinal axis (cf. FIG. 5*b*). A sponge (40) of this size and shape has been found most useful for the cleaning of e.g. Hi-fi equipment. A third sponge (40) is comprised, the cross-section of which (in the plane perpendicular to the longitudinal axis of the applicator (10)) is triangular and more particularly has the shape of a isosceles triangle with a base length of about 55 mm for each side (cf. FIG. 6*a*). The wiping surface is essentially perpendicular to the longitudinal axis of the applicator (10) (cf. FIG. 6*b*). This size and shape of the sponge (40) have been found particularly useful for the cleaning of larger surfaces e.g. the screen of a TV-set. Of course, the present invention is not limited to particularly sets of sponges (40) or sponges (40) of any shape (including namely any cross-section and thickness), size and material. Also the wiping surface may be tilted with regard to the plane perpendicular to the longitudinal axis at any angle.

While any sponge (40) is suitable, most preferred are dual layer sponges (40), which preferably comprise a closed cell foam layer and an open cell foam layer. Preferably the compression resistance of the layer to contact the devices to be cleaned is from 0.5 kPa to 10 kPa, more preferably 1 kPa to 4 kPa, while the compression resistance of the layer contacting the sponge mounting is from 1 kPa to 200 kPa, more preferably 5 kPa to 100 kPa. An open cell foam layer absorbs and distributes the cleaning composition well. Therefore, it is preferred to use such layer for contact with the device to be cleaned. However, especially for a large sponge (40) which is provided from opened cell foam the absorptive capacity of the sponge (40) becomes very large and more cleaning composition than needed is absorbed and hence cleaning composition, which often is expensive, remains unused. Therefore, preferred dual layer sponges (40) employ a closed cell foam in contact with the mounting (42) of the sponge (40). Such closed cell foam layer does have a very low absorptive capacity and hence easily transmits the cleaning composition, but is soft and flexible and therefore ensures a good contact of the wiping surface with the object to be cleaned and further has damping properties as to ensure a soft and gentle cleaning and to prevent contact of the mounting (42) of the sponge (40) with the device to be cleaned.

A preferred applicator (10) according to the present invention also comprises a storage device for the cleaning composition. Most preferably, such storage device is provided in form of a cartridge (20) which fits into the main chassis (12) of the applicator (10), but is a separate piece and can be replaced by another cartridge (20). Such cartridge (20) may be a refillable cartridge (20) or may be a non-refillable cartridge (20). The cartridge (20) may comprise a pumping device (22) for the cleaning composition or a pumping device (22) may be provided separately from the cartridge (20). In a most preferred embodiment of the present invention a non-refillable cartridge (20) is provided together with a pump (22) which seals the cartridge (20) so that the consumer does not come into contact with the cleaning composition. While any pumping device (22) is in accordance with the present invention a preferred pumping device (22) will be small in size as to fit into the applicator (10) and will deliver a pre-defined and small amount of cleaning composition each time the pumping device (22) is activated. The preferred amount of cleaning composition released each time the pump (22) is activated is from 0.01 ml to 0.1 ml, more preferably from 0.05 ml to 0.1 ml. Preferably, the storage device allows to store from 1 ml to 100 ml of cleaning composition, more preferably from 3 ml to 20 ml, most preferably from 5 ml to 10 ml of the cleaning composition.

A particularly preferred pumping device (22) according to the present invention is a miniature pump in combination with a capillary (24) extending into the storage device and being in liquid communication with the cleaning composition. With such pumping device (22) upon mechanical pressure a vacuum is created which leads to the release of the defined amount of cleaning composition present in the capillary (24). Such a mechanism is not only cheap to produce but ensures the release of a pre-defined amount of cleaning composition each time the pump (22) is activated. In a further aspect of such pumping device (22), which is particularly relevant to the present invention, this device cannot be operated when being held upside down or horizontally: When pumping device (22) and cartridge (20) are held upside down or horizontally the end of the capillary (24) is no more in liquid communication with the cleaning composition and therefore no cleaning composition can be released. Typically, the pumping device (22) is operated by exertion of pressure via the sponge (40) and the sponge (40) mounting onto the pumping device (22). Hence, the pumping device (22) could be operated unintentionally when the sponge (40) is used for spreading cleaning composition. However, when the device is used for spreading cleaning composition it is typically held upside down or in a horizontal position and when the pumping device (22) described above is used unintentional release of cleaning composition is therefore prevented.

Preferably the main chassis (12) of the applicator (10) is provided with a visual indicator which indicates to a user, how much cleaning composition is left in the cartridge. Preferably such visual indicator is present in the main chassis (12) in the form of a broken wall or window (14).

The applicator (10) according to the present invention can optionally provided with a brush (30). While such brush (30) can be made of any material including any artificial material and also hair, preferred materials are PET and nylon. The brush (30) can be used for the dusting of surfaces. This dusting may be independent from the application of cleaning composition or may be a preparational step for the later application of the cleaning composition. In the preferred embodiment of the applicator (10) shown in FIGS. 1 to 3, the brush (30) is protected by a sliding protector which is movably attached to the main chassis (12) of the applicator (10). When the brush (30) is not used the sliding brush protector (32) will fully cover the brush (30). When the brush (30) is used the protector (32) can be slided over the main chassis (12).

According to the present invention it is contemplated to provide the cleaning composition and the cleaning applicator (10) and other parts in form of the kit. One preferred such kit, referred to as "starter kit", may comprise the complete applicator (10) including one sponge (40) and sponge mounting (42) and one cartridge (20) and may further comprise any number of, preferably one or two, further cartridges (20) and sponges (40) and sponge mountings (42). A particularly preferred set of sponges (40) is the set of three sponges (40) depicted in FIGS. 4*a*–6*b*. A starter kit may also comprise further cartridges with cleaning composition. A further preferred kit according to the present invention, referred to as "refill kit", may comprise any number of cartridges with cleaning composition and may further comprises replacement sponges (40). The replacement sponges (40) may be provided with or without a respective sponge mounting (42).

The cleaning composition disclosed herein has been found highly suitable to be used for any type of office and household equipment. Preferred is the use of the cleaning composition according to the present invention on devices belonging to the group of devices operated by electrical power, irrespective if the power is supplied externally, typically via a power cable, or is supplied internally e.g. by a battery or solar cell. Even more preferred is the use of the cleaning composition according to the present invention on devices belonging to the group of devices comprising an electronic circuit. Also preferred is the use of the cleaning composition according to the present invention on devices belonging to the group of devices comprising optical elements, e.g. lenses. Highly preferred is the use of the cleaning composition according to the present invention on devices belonging to the group of devices which are encapsulated by a housing, box, chassis, frame or the like. Also highly preferred is the use of the cleaning composition according to the present invention on devices belonging to the group of devices comprising a user interface, which may e.g. comprise a keyboard, a keypad, a touch screen, a single switch or a set of switches. Most preferred is the use of the cleaning composition according to the present invention for devices which fall into two, preferably three, most preferably all of the above defined groups of devices.

Examples of devices for which the disclosed cleaning composition is highly suitable include all audio and video devices, namely: TV sets, Hi-fi stereo sets and their respective components (cassette player, tuner, turn-table, amplifier, loudspeaker; etc.) and front panels, video tape recorder, MP3 player, CD/DVD players, musical instruments, like electronic pianos, portable devices of the named kinds (including devices commonly referred to as "Walkman") and remote controls for any such device.

Other examples include personal communication devices, namely desktop and cellular phones, fax machines and answering machines.

Further examples include optical equipment, namely photo cameras and video cameras, camcorders, magnification lenses, glasses and projectors.

Further examples include data processing devices and related devices, namely personal desktop, portable computers, palmtop computers, personal organisers and peripheral equipment, including printers, storage devices, scanners and keyboards, LCD screens, CRT screens, monitors, and touch LCD screens.

Yet further examples include a number of portable devices, namely hand-held or desktop electronic games (such devices are frequently referred to as "game-boys" or "play stations").

Even further examples include office and business equipment, namely photocopy machines, cashier terminals, calculators.

Yet even further examples include household appliances such as coffee machines, toasters, water boilers, ovens and their front panels, dish washers and their front panels, fridges, vacuum cleaners, tools and power tools (e.g. electric drills) and the like.

Even further examples include precious items, namely watches, jewelery, coins, silverware and the like.

Other examples include control panels and displays of aircraft, ships, cars, trains, and any other electronic device or instrumentation.

Even further examples include control panels of power plants, chemical plants, mechanical plants, water treatment plants, textile plants, pharmaceutical plants, food and beverage processing plants, and any industrial plant in general.

Even further examples include all kinds of scientific devices and equipment, such as electron microscopes, spectrophotometers, atomic absorption spectrometers, mass spectrometers, gas chromatographs, HPLC's, refractometers, NMR spectrometers, and any kind of spectrometer including optical parts.

Even further examples include any diagnostic devices and equipment for medical applications, such as echographs; devices for X-ray, computerized axial tomography, scintigraphy, NMR, and any other radiological device; electrographs, echocardiographs, electronic equipment in surgery operations, apparatuses for blood pressure measurement; devices and equipment used in ophthalmology; devices and equipment used for clinical analyses; and any delicate instrument in general used for medical application, particularly those including electronic and/or optical parts.

Friction Resistance

Friction resistance, as used herein, refers to friction force per contact area and is measured as follows: The application device is clamped to the load arm of a Plint dual axis reciprocating rig (such as model TE75R, MRPRA RUBBER CONSULTANTS). The angle of the fabric treatment applicator relative to the contact surface is adapted to maximise the contact area. The clamping arrangement provided a consumer realistic vertical load, R, on the application device of 3N. The coefficient of friction is then measured between the application device and a window glass surface mounted on soft counter surface provided by a 2 mm thick sheet of soft rubber mounted with double sided adhesive to a flat aluminium plate. The application device is measured wet using a composition as given in Example 1. The coefficient of friction is measured over the central 10 mm of four traverses of 20 mm in both the forward and reverse direction at a speed of 1 mm $s^{-1}$ and an average value calculated. Measurements with the application device in final measuring position are repeated three times to check reproducibility.

Compression Resistance

Compression resistance is measured in accordance with ISO 3386-1 norm and, as used herein, refers to the median $CV_{40}$ value as defined in ISO 3386-1, measured at a temperature of 23 degree Celsius and 50% relative humidity.

The disclosure of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

While particular embodiments of the present invention have been illustrated and described, it would be obvious to those skilled in the art that various other changes and modifications can be made without departing from the spirit and scope of the invention. The invention is only intended to be limited by the following claims.

What is claimed is:

1. A cleaning composition for cleaning electronic equipment and electric or electronic appliances comprising:

a) from about 20% to about 98%, by weight, of at least one fluorinated carbon compound;

b) a non-fluorinated solvent;

c) a non-fluorine containing surfactant selected from the group consisting of non-ionic, anionic, cationic, ampholytic, zwitterionic surfactants, and mixtures thereof, wherein said non-ionic surfactants are selected from the group consisting of alkoxylated non-ionic surfactants, polyhydroxy fatty acid amides, fatty acid amide surfactants, alkoxylated fatty acid amides, alkyl esters of a fatty acid, alkylpolysaccharides, semi-polar non-ionic surfactants, amine oxide surfactants, co-surfactants comprising primary or tertiary amines, and mixtures thereof; said anionic surfactants are selected from the group consisting of linear alkyl benzene sulfonate, alkyl ester sulfonate surfactants, alkyl sulfate surfactants which are water soluble salts or acids of the formula $ROSO_3M$ wherein R is a $C_{10}$–$C_{24}$ hydrocarbyl and M is H or a cation, salts of soap, $C_8$–$C_{22}$ primary or secondary alkanesulfonates, $C_8$–$C_{24}$ olefinsulfonates, sulfonated polycarboxylic acids, $C_8$–$C_{24}$ alkylpolyglycolethersulfates; alkyl glycerol sulfonates, fatty acyl glycerol sulfonates, fatty oleyl glycerol sulfates, alkyl phenol ethylene oxide ether sulfates, paraffin sulfonates, alkyl phosphates, alkylpolyglycoletherphosphates, isethionates, N-acyl taurates, alkyl succinamates and sulfosuccinates, monoesters of sulfosuccinates and diesters of sulfosuccinates, acyl sarcosinates, sulfates of alkylpolysaccharides, branched primary alkyl sulfates, alkyl polyethoxy carboxylates, resin acids, hydrogenated resin acids, and alkyl alkoxylated sulfate surfactants which are water soluble salts or acids of the formula $RO(A)_mSO3M$ wherein R is an unsubstituted $C_{10}$–$C_{24}$ alkyl of hydroxyalkyl group having a $C_{10}$–$C_{24}$ alkyl component, A is an ethoxy or propoxy unit, m is greater than zero, and M is H or a cation; and said cationic surfactants are selected from the group consisting of ammonium surfactants and quaternary ammonium surfactants; and d) from 0.2% to 5% water, wherein said cleaning composition for cleaning electronic equipment and electric or electronic appliances has a dielectric constant of less than 30.

2. A composition according to claim 1 wherein the fluorinated carbon compound is a perfluoropolyether or an H-terminated perfluoropolyether.

3. A composition according to claim 1 further comprising a perfume.

4. A composition according to claim 1 wherein said one or more non-fluorinated solvents are selected from the group consisting of: alcohols; glycols; polyalcohols; ethers; polyethers; ketones; paraffins; saturated or unsaturated, linear or branched or cyclic hydrocarbons; esters; and mixtures thereof.

5. A composition according to claim 1 wherein said surfactant is selected from the group consisting of coconut trimethyl ammonium chloride or bromide, coconut methyl dihydroxyethyl ammonium chloride or bromide, decyl triethyl ammonium chloride, decyl dimethyl hydroxyethyl ammonium chloride or bromide, $C_{12-15}$ dimethyl hydroxyethyl ammonium chloride or bromide, coconut dimethyl hydroxyethyl ammonium chloride or bromide, myristyl trimethyl ammonium methyl sulphate, lauryl dimethyl benzyl ammonium chloride or bromide, lauryl dimethyl $(ethenoxy)_4$ ammonium chloride or bromide, choline esters, di-alkyl imidazolines, ditallow dimethylammonium chloride, dihydrogenated tallow dimethylammonium chloride, dihydrogenated tallow dimethylammonium methylsulfate, distearyl dimethylammonium chloride, dioleyl dimethylammonium chloride, dipalmityl hydroxyethyl methylammonium chloride, stearyl benzyl dimethylammonium chloride, tallow trimethylammonium chloride, hydrogenated tallow trimethylammonium chloride, $C_{12-14}$ alkyl hydroxyethyl dimethylammonium chloride, $C_{12-18}$ alkyl dihydroxyethyl methylammonium chloride, di(stearoyloxyethyl) dimethylammonium chloride, di(tallow-oxy-ethyl) dimethylammonium chloride, ditallow imidazolinium methylsulfate, 1-(2-tallowylamidoethyl)-2-tallowyl imidazolinium methylsulfate, N,N-di(tallow-oxy-ethyl)-N,N-dimethyl ammonium chloride, N,N-di(tallowyl-oxy-ethyl)-N-methyl, N-(2-hydroxyethyl) ammonium methyl sulfate, N,N-di(2-tallowyl-oxy-2-oxy-ethyl)-N,N-dimethyl ammonium chloride, N,N-di(2-tallowyl-oxy-ethylcarbonyl-oxy-ethyl)-N,N-dimethyl ammonium chloride, N-(2-tallowyl-oxy-2-ethyl)-N-(2-tallow-oxy-2-oxo-ethyl)-N,N-dimethyl ammonium chloride, N,N,N-tri (tallowyl-oxy-ethyl)-N-methyl ammonium chloride, N-(2-tallowyl-oxy-2-oxo-ethyl)-N-(tallowyl-N,N-dimethyl-ammonium chloride, 1,2-ditallowyl-oxy-3-trimethylammoniopropane chloride, and mixtures thereof.

6. A composition according to claim 1 further comprising a material selected from the group consisting of oils, preservatives, anti-static agents, fragrances, odor absorbing components, and mixtures thereof.

* * * * *